United States Patent [19]

Mannhart

[11] Patent Number: 4,742,756

[45] Date of Patent: May 10, 1988

[54] APPARATUS FOR FEEDING CARTRIDGES FROM A DRUM MAGAZINE TO A FIRING WEAPON

[75] Inventor: Peter Mannhart, Hochdorf, Switzerland

[73] Assignee: Werkzeugmaschinenfabrik Oerlikon-Bührle AG, Zürich, Switzerland

[21] Appl. No.: 8,772

[22] Filed: Jan. 30, 1987

[30] Foreign Application Priority Data

Feb. 4, 1986 [CH] Switzerland ..... 00423/86

[51] Int. Cl.[4] ..... F41D 10/24

[52] U.S. Cl. ..... 89/33.02

[58] Field of Search ..... 89/33.02

[56] References Cited

U.S. PATENT DOCUMENTS 3,683,743 8/1972 Stoner ..... 89/33.02

3,969,980 7/1976 Brandstätter et al. ..... 89/33.02

4,589,325 5/1986 Müller et al. ..... 89/33.02

FOREIGN PATENT DOCUMENTS 0111780 6/1984 European Pat. Off. ..... 89/33.02

*Primary Examiner*—Stephen C. Bentley

*Attorney, Agent, or Firm*—Werner W. Kleeman

[57] ABSTRACT

During the infeed of cartridges into a firing weapon cartridges are withdrawn from the sectors of a drum magazine using a first conveyor, and subsequently transferred to a second conveyor which conveys the cartridges to the firing weapon. A return or reverse movement blocking device prevents the cartridges from dropping back into already emptied sectors of the drum magazine. Such return or reverse movement blocking device possesses two pivotable flaps or vane members which may be interconnected and conjointly form a funnel-shaped channel through which the cartridges are displaced by the first conveyor from the drum magazine to the second conveyor.

4 Claims, 4 Drawing Sheets

APPARATUS FOR FEEDING CARTRIDGES FROM A DRUM MAGAZINE TO A FIRING WEAPON

BACKGROUND OF THE INVENTION

The present invention broadly relates to a new and improved construction of an apparatus for feeding cartridges from a drum magazine to a firing weapon.

Generally speaking, the cartridge feeding apparatus of the present invention comprises a drum-type magazine or drum magazine which is subdivided into a predetermined number of sectors. in each sector there is located a row of cartridges. A first conveyor or conveying means consecutively outwardly displaces or ejects the rows of cartridges from the sectors of the drum-type magazine. A second conveyor or conveying means is provided for conveying the cartridges which have been displaced or ejected from the sectors of the drum-type magazine, to the firing weapon. Rotary drive means are provided for rotating the drum-type magazine in a predetermined rotational direction. Each one of the sectors of the drum-type magazine thus arrives at a removal or ejection location during rotation of the drum-type magazine in the predetermined rotational direction. Each row of cartridges is outwardly displaced or ejected in a predetermined direction from the sector which is located at the removal or ejection location. The first conveyor or conveying means is arranged at a predetermined inclination and this inclination is determined as the resultant formed by the predetermined rotational direction of the drum-type magazine and the predetermined direction in which the cartridges are outwardly displaced or ejected from the sectors of the drum-type magazine. A return or reverse movement blocking device is arranged between the first conveyor or conveying means and the second conveyor or conveying means in order to prevent cartridges from dropping into the already emptied sectors of the drum-type magazine.

In a cartridge feed apparatus of this type as known, for example, from the commonly assigned European Patent Publication No. 0,111,780, published June 27, 1984 and its cognate U.S. Pat. No. 4,589,325, granted May 20, 1986, the subject matter of which is herein incorporated by reference, the return or reverse movement blocking device is formed by a slide member possessing a throughpass opening for the cartridges ejected from the sectors of the drum-type magazine. The return or reverse movement blocking device further possesses a deflection member or deflector by means of which the cartridges are directed into individual receiving members or cradles of a conveyor chain of the second conveyor or conveying means. In another construction of this prior art apparatus the return or reverse movement blocking device is formed by pivotable flaps which are linked to the ejection end of guide rails of the drum-type magazine. The flaps open during ejection of the cartridges but prevent the cartridges from dropping back into the sectors of the drum-type magazine.

This known system and the first embodiment as well as the second embodiment thereof have the disadvantage of not operating sufficiently reliably at high firing cadences or rates of the firing weapon, so that all types of malfunctions, faults and other problems are caused.

SUMMARY OF THE INVENTION

Therefore, with the foregoing in mind it is a primary object of the present invention to provide a new and improved construction of an apparatus for feeding cartridges from a drum magazine to a firing weapon and which apparatus does not exhibit the aforementioned drawbacks and shortcomings of the prior art constructions.

Another and more specific object of the present invention aims at providing a new and improved construction of an apparatus for feeding cartridges from a drum magazine to a firing weapon and in which apparatus the cartridges are reliably transferred from the first conveyor or conveying means to the second conveyor or conveying means substantially without any malfunctions during the transition from one sector to the next-following sector of the drum magazine.

A still further significant object of the present invention is directed to the provision of a new and improved construction of an apparatus for feeding cartridges from a drum magazine to a firing weapon and which apparatus can be operated substantially without any malfunctions and deficiencies such that, as soon as the last cartridge of one sector of the drum magazine has been transferred to the second conveyor or conveying means, the first cartridge of the next-following sector of the drum magazine is fed to the second conveyor or conveying means substantially without interruption.

Yet a still further significant object of the present invention aims at providing a new and improved construction of an apparatus for feeding cartridges from a drum magazine to a firing weapon and which apparatus is relatively simple in construction and design, extremely economical to manufacture, highly reliable in operation, not readily subject to breakdown and malfunction and requires a minimum of maintenance and servicing.

Now in order to implement these and still further objects of the present invention which will become more readily apparent as the description proceeds, the apparatus of the present development is manifested the features that, the return or reverse movement blocking device contains at least two pivotable flaps or vane members which are operatively associated with one another. These at least two pivotable flaps or vane members are preferably interconnected. The at least two pivotable flaps or vane members conjointly form a funnel-shaped pivotable channel through which cartridges are displaced from the drum magazine by means of the first conveyor or conveying means to the second conveyor or conveying means.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
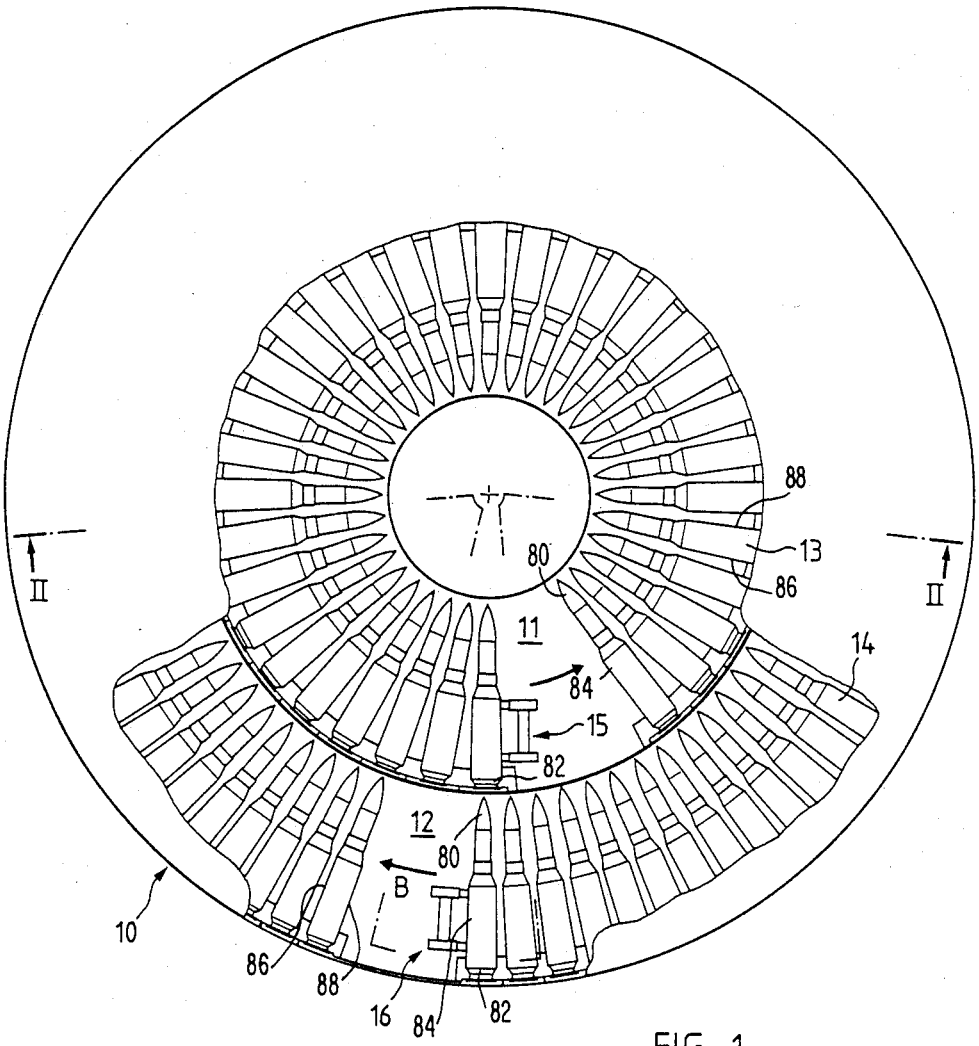
FIG. 1 is a top plan view, partially in section, of a known drum magazine containing two first conveyors.
Figure 2:
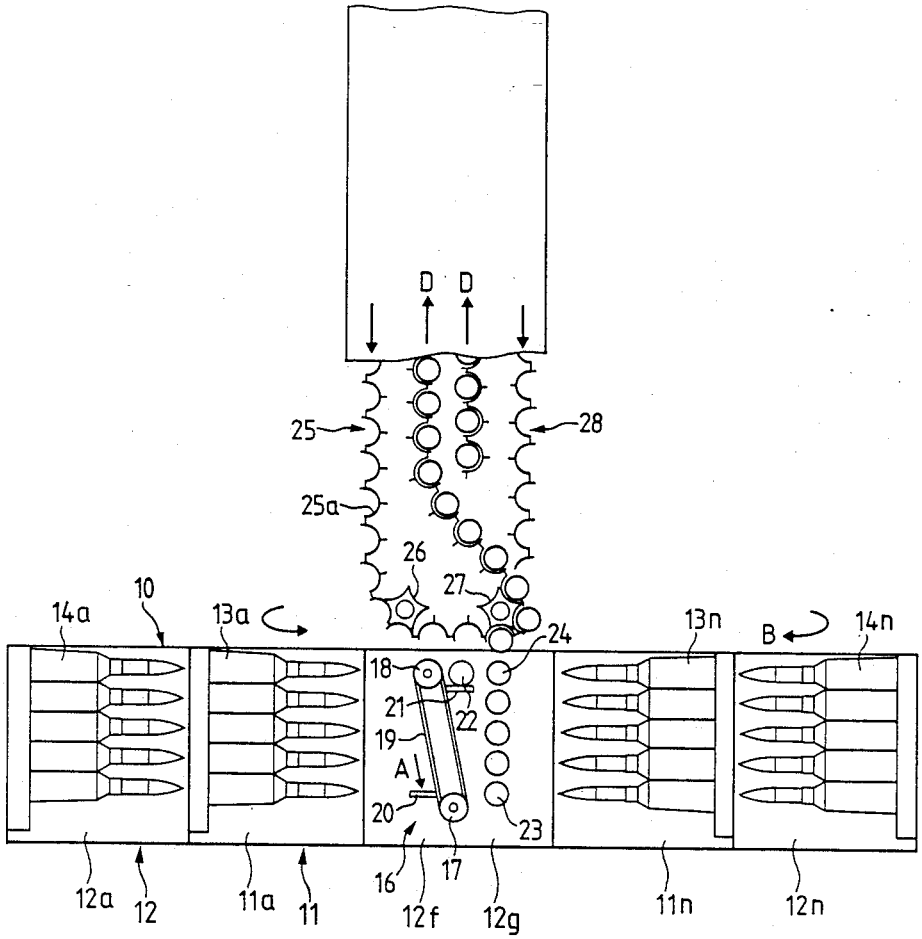
FIG. 2 is a section along the line II—II in FIG. 1 and shows one of the two first conveyors.

Describing now the drawings, it is to be understood that to simplify the showing thereof only enough of the structure of the inventive cartridge feeding apparatus has been illustrated therein as is needed to enable one skilled in the art to readily understand the underlying principles and concepts of the present invention. Turning now specifically to FIGS. 1 and 2 of the drawings, the conventional cartridge feeding apparatus illustrated therein will be seen to comprise a drum-type or drum magazine 10 possessing an inner round container or bay 11 and an outer round container or bay 12. The inner round container or bay 11 typically contains a first type of ammunition or cartridges 13 and the outer round container or bay 12 typically contains a second type of ammunition or cartridges 14. Both containers 11 and 12 are subdivided into a predetermined number of sectors of which the sectors 11*a*, 11*n* and 12*a*, 12*n* are visible in the cross-sectional illustration of FIG. 2. As can be seen in FIG. 2, each one of the sectors 11*a*, 11*n*, 12*a*, 12*n* contains a respective row 13*a*, 13*n*, 14*a*, 14*n* of for instance five cartridges. It will be observed from FIG. 1, each of the cartridges 13 and 14 contains a first end portion 80 defining the cartridge tip, an oppositely situated second end portion 82 defining the cartridge base, and an intermediate portion 84 between the first end portion 80 and the second end portion 82. Each cartridge 13 and 14 also has the oppositely situated cartridge sides 86 and 88.

Within the confines of the inner round container or bay 11 there is arranged one first conveyor or conveying means 15, and within the confines of the outer round container or bay 12 there is arranged a further first conveyor or conveying means 16. These two first conveyors or conveying means 15 and 16 are also called cartridge removal or ejection devices or "inclined extractor" for the cartridges and are substantially identical. From FIG. 2 and the following description thereof the term "inclined extractor" will become better understandable. In the following description there will be explained only one of the two first conveyors or conveying means 15 or 16 and it will be understood that the description is likewise applicable to the other such first conveyor or conveying means.

With respect to FIGS. 2 and 3, the description will be made, for instance, with reference to the first conveyor or conveying means 16 which is operatively associated with the outer round container or bay 12. This first conveyor 16 contains two deflection rolls 17 and 18 about which an endless belt 19 is trained or guided. Instead of the single deflection rolls 17 and 18 (FIG. 2), there may also be provided two deflection rolls or roll pairs 17, 17*a* and 18, 18*a* (FIG. 3), and instead of a single wide endless belt 19 (FIG. 2) there may be provided two smaller endless belts 19 and 19*a* (FIG. 3).

Figure 3:
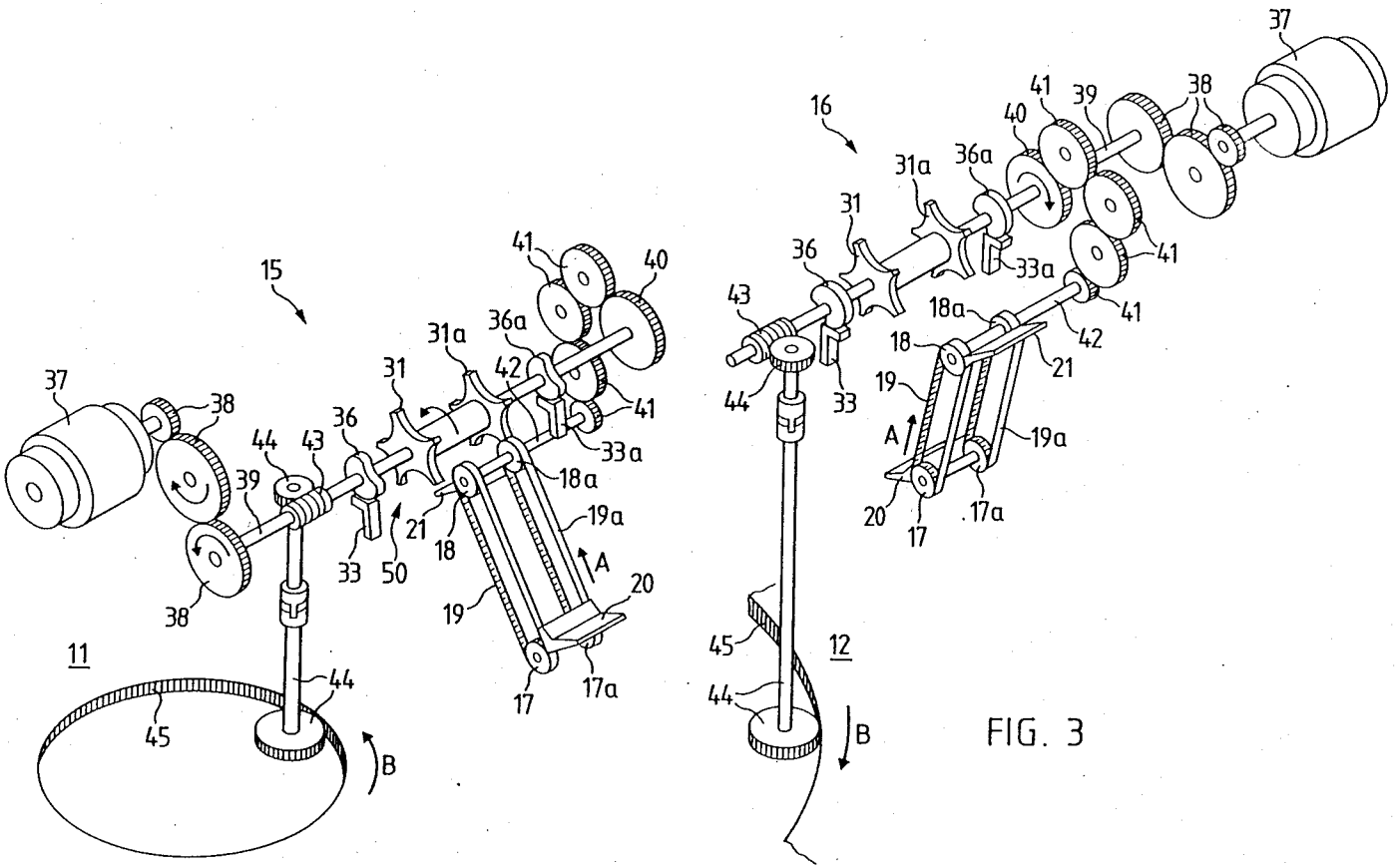
FIG. 3 is a perspective illustration of the two first conveyors of an exemplary embodiment of the inventive apparatus.

Two cartridge entrainment members 20 and 21 are mounted at the endless belts 19 and 19*a*, see FIG. 3. The endless belt 19 or, as the case may be, endless belts 19 and 19*a* together with both of the entrainment members 20 and 21 moves in the direction indicated by the arrow A and during such movement the upper entrainment member 21 outwardly displaces or ejects a cartridge 22 from the associated sector, such as the sector 12*f* of the drum-type or drum magazine 10 as shown in FIG. 2. This cartridge 22 is the last cartridge of the row of cartridges which previously were located in the sector 12*f*. Thereafter the lower entrainment member 20 will abut against the lowermost cartridge 23 of the cartridge row in the next-following sector 12*g* and initially outwardly displaces or ejects the topmost cartridge 24 of this next-following sector 12*g* from the drum-type magazine 10 and then the successive cartridges of this cartridge row.

During the removal or ejection of the cartridges from the outer round container or bay 12, the entire drum-type magazine 10 turns or rotates in clockwise direction, i.e. in the direction indicated by the arrow B in FIGS. 1 to 3. Such rotation of the drum-type magazine 10 during the removal or ejection of the cartridges from the drum-type magazine 10 causes the cartridge 23 to move upwardly at an inclination during the cartridge removing or ejecting operation by means of the first conveyor or conveying means 16. This cartridge 23 thus arrives at the location which was previously occupied by the cartridge 22 as illustrated in FIG. 2. The cartridge 22 of one sector, namely here the sector 12*f* and the cartridge 24 of the next-following sector, namely here the sector 12*g* therefore, are not transferred to the second conveyor or conveying means 25 at the same location.

Figure 4:
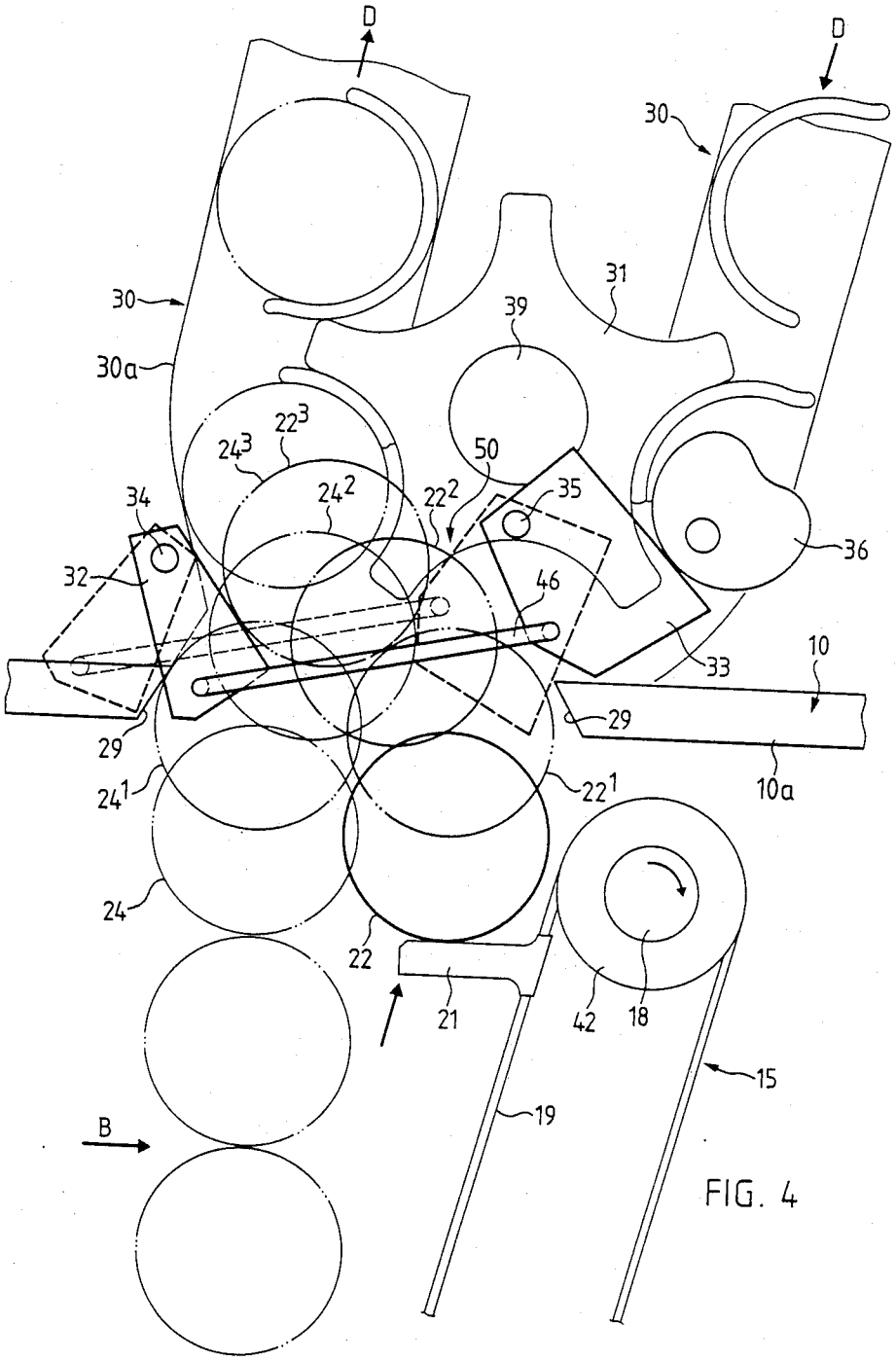
FIG. 4 schematically illustrates the transition region between one of the first conveyors and the second conveyor in the inventive apparatus shown in FIG. 3.

The endless second conveyor or conveying means 25 delivers or conveys the cartridges in the direction indicated by the arrows D and feeds the cartridges to a not particularly illustrated firing weapon. As shown in FIG. 2, a conveyor band or belt 25*a* of the second conveyor or conveying means 25 is guided or trained about two deflection rolls 26 and 27. As shown in FIG. 4, a conveyor band or belt 30*a* of the second conveyor or conveying means 30 is guided or trained about a single or associated deflection roll 31 and this second conveyor or conveying means 30 is operatively associated through the first conveyor or conveying means 15 with the inner round container or bay 11.

In accordance with FIG. 2, the endless conveyor band or belt 25*a* of the second conveyor or conveying means 25, which is operatively associated with the outer round container or bay 12, moves substantially in horizontal direction from deflection roll 26 to deflection roll 27. It is therefore of no importance for the conventional apparatus that, as mentioned hereinbefore, the cartridge 22 is transferred from the outer round container or bay 12 to the second conveyor or conveying means 25 at a location which is different from the transfer location of the cartridge 24 which is transferred to the conveyor band or belt 25*a* of the second conveyor or conveying means 25 at a location further to the right as shown in FIG. 2. The cartridges from the inner round container or bay 11 are transferred to a second conveyor band or belt 28 of the second conveyor or conveying means 25 which moves in the direction indicated by the arrows D. The first conveyor or conveying means 15, which is operatively associated with the second conveyor band or belt 28 of the second conveyor or conveying means 25, removes or ejects the cartridges from the inner round container or bay 11. The second conveyor band or belt 28 is also guided or trained about not specifically illustrated deflection rolls which are arranged substantially coaxially to the deflection rolls 26 and 27, however, rotate in the opposite rotational direction.

It has now been found that the ammunition or cartridge feed apparatus as described hereinbefore can be substantially simplified, i.e. the transfer of the cartridges from the first conveyors or conveying means 15 and 16 to the second conveyor or conveying means 25 or its respective conveyor bands or belts 25a and 28 can be substantially simplified as will be explained hereinafter with reference to FIGS. 3 and 4 and an exemplary embodiment of the inventive ammunition feed apparatus illustrated therein.

Referring now to FIG. 3, and with respect to the first conveyor or conveying means 15 associated with the inner container 11 a drive motor 37 drives a shaft or drive shaft 39 through three gear wheels 38. Mounted at this shaft or drive shaft 39 are the deflection rolls 31 and 31a, which are constructed as sprocket or star wheels in the illustrated embodiment, and a gear wheel 40 which drives the first conveyor or conveying means 15 through gear wheels or gear train 41. The gear wheels 41, in turn, drive a shaft 42 at which there are mounted the deflection rolls 18 and 18a of the first conveyor 15. A worm gear 43 is also mounted at the shaft or drive shaft 39 and drives the associated inner round container or bay 11 through a transmission 44. Only an inner gear rim or internal annular ring gear 45 has been shown of the associated inner container 11 in FIG. 3. From the arrow B it is apparent that the inner round container container or bay 11 turns or rotates in a given rotational direction.

From the foregoing discussion it will be apparent that a corresponding arrangement is provided for the first conveyor or conveying means 16 operatively associated with the outer round container or bay 12 which, however, rotates in an opposite rotational sense in relation to the inner container 11.

In FIG. 4 only the upper portion of the first conveyor or conveying means 15 has been conveniently illustrated, namely the upper deflection roll 18, the endless conveyor band or belt 19 and the one entrainment member 21 which is removing or ejecting the cartridge 22 from the associated sector of the drum-type magazine 10. Only an upper stationary wall 10a of this drum-type magazine 10 has been shown in FIG. 4 and this upper wall 10a contains an aperture or opening 29 which is just big enough that on the right-hand side the last cartridge 22 of the one sector and subsequently on the left-hand side the first cartridge 24 of the next-following sector can be removed or ejected from the drum-type magazine 10. As shown in FIG. 4, the conveyor band or belt 30a of the second endless conveyor or conveying means 30 is guided or trained about a single deflection roll forming the star wheel 31 which moves in the direction of the arrows D in FIG. 4.

In FIG. 4 there are shown the cartridges 22 and 24 in four different positions at different moments of time during the transfer from the first conveyor or conveying means 15 to the associated second conveyor or conveying means 30. The four different positions are respectively designated by the reference numerals 22, $22^1$, $22^2$ and $22^3$ as well as 24, $24^1$, $24^2$, and $24^3$. It should be noted that the last position $22^3$ of the cartridge 22 coincides with the last position $24^3$ of the other or next-following cartridge 24.

In order to ensure reliable guidance of the two cartridges 22 and 24 during the transfer from the first conveyor or conveying means 15 to the associated second conveyor or conveying means 30 there are provided return or reverse movement blocking devices 32, 33, namely two pivotable flaps or vane members 32 and 33 which are pivotable about respective pins or journals 34 and 35, for the pair of operatively associated first and second conveyors or conveying means 15 and 30. These first and second conveyors or conveying means 15 and 30 cooperate with the inner round container or bay 11 of the drum-type magazine 10 in substantially the same manner as the conveyors or conveying means 16 and 25 cooperate with the outer round container or bay 12 and with correspondingly constructed and arranged return or reverse movement blocking devices. This inner round container or bay 11 contains sections filled with cartridges in a manner essentially corresponding to the cartridges in the outer round container or bay 12. It is for this reason that in the present description of FIG. 4 the same reference numerals used in FIG. 2 for the cartridges thereof have been also conveniently used for the cartridges in the present discussion of FIG. 4.

For the transfer of the cartridge 22 to the second conveyor or conveying means 30 the two flaps or vane members 32 and 33 assume the position shown by solid lines in FIG. 4. For the transfer of the cartridge 24 to the second conveyor or conveying means 30 the two pivotable flaps or vane members 32 and 33 assume the position shown by broken lines in FIG. 4. A cam disc or plate 36 serves for pivoting the two flaps or vane members 32 and 33 and acts such as to pivot the flap or vane member 33 from the first position indicated by solid lines into the second position indicated by broken lines. The other flap or vane member 32 is moved or pivoted by means of a slide member or rod 46 which interconnects the two flaps or vane members 32 and 33. The aperture or opening 29 of the upper stationary wall 10a of the drum magazine 10 is stationary. The cam disc or plate 36 is also shown in FIG. 3 as mounted at the shaft or drive shaft 39; in the simplified schematic illustration of FIG. 4, the cam disc or plate 36 is conveniently shown in a lower position and to the right of the shaft 39 or drive shaft so that it is visible in the showing of FIG. 4.

It will be appreciated from the illustration of FIG. 4, that the two flaps or vane members 32 and 33 are arranged in each one of their pivot positions in such a manner that the two flaps or vane members 32 and 33 conjointly form an approximately funnel-shaped throughpass channel 50 in the transition region between the first conveyor or conveying means 15 and the associated second conveyor or conveying means 30. The two flaps or vane members 32 and 33 thus ensure trouble-free transfer of the cartridges from the first conveyor or conveying means 15 to the associated second conveyor or conveying means 30.

The mode of operation of the aforedescribed cartridge feed apparatus is described hereinafter with reference to FIGS. 3 and 4 and is as follows:

During a firing burst or series firing one of the two electric drive motors 37 is activated in accordance with the desired type of ammunition then to be fired. As a consequence, the shaft or drive shaft 39 is driven through the gear wheels 38 and the shaft or drive shaft 42 is driven through the gear wheels 40 and 41. The shafts or drive shafts 39 and 42, in turn, drive the thus activated first conveyor 15 or 16 as shown in FIGS. 3 and 4. It is here assumed that, for instance, at this time the first conveyor 15 is activated. This first conveyor or conveying means 15 initially removes or ejects the last cartridge 22 from a predetermined sector of the inner round container or bay 11 in the drum-type magazine 10 and incrementally or in steps moves the cartridge 22 through the positions $22^1$, $22^2$ and $22^3$; during this operation the upper entrainment member 21 is effective. Subsequently, the first conveyor or conveying means 15 removes or ejects the first cartridge 24 from the next-following sector of the drum-type magazine 10 and incrementally or in steps moves this first cartridge through the positions $24^1$, $24^2$ and $24^3$; during this operation the lower entrainment member 20 is effective, see FIG. 3.

During the outward displacement of the last cartridge 22 from the predetermined sector, the two flaps or vane members 32 and 33 assume the position as indicated by solid lines in FIG. 4. During the outward displacement of the first cartridge 24 from the next-following sector the flaps or vane members 32 and 33 assume the position as indicated by the broken lines in FIG. 4. After the outward displacement of the last cartridge 22 from the predetermined sector and prior to the outward displacement of the first cartridge 24 from the next-following sector it is therefore necessary to pivot the flaps or vane members 32 and 33 from the position indicated by solid lines into the position indicated by broken lines. Subsequently, the two flaps or vane members 32 and 33 are pivoted to a slight extent in the direction indicated by the arrow B with each one of the cartridges in the associated row. This is required because also the drum-type magazine 10 is moved in the direction of the arrow B during the outward displacement or ejection of the cartridges by means of the first conveyor or conveying means 15.

Instead of the slide member or rod 46 illustrated in FIG. 4, each individual flap or vane member 32 and 33 may be driven or pivoted by means of a separate cam disc or plate 36 associated therewith. It is apparent from FIG. 3 that the one flap or vane member 33 can be replaced by two flaps or vane members 33 and **33*a* which are series-arranged or in tandem and supported at the common shaft 34. In this arrangement one flap or vane member 33 supports a rear end portion or base of a cartridge 22 or 24, as the case may be. The other flap or vane member 33*a* supports a front end portion or tip of the same cartridge 22 or 24. The opposite situated flap or vane member 32 supports a central portion or region of the cartridge 22 or 24**.

The cartridges 22 and 24 in the drum-type magazine 10 move along a circle as shown in FIG. 1. Therefore, the front end portion of the cartridge 22 or 24 travels a smaller distance than the rear end portion thereof. The two flaps or vane members 33 and **33*a*, which are series-arranged or in tandem, therefore, must not be pivoted to the same extent. Preferably and for this reason there is thus provided an individual control cam 36 and 36*a* for each one of the pivotable flaps or vane members 33 and 33*a*. The control cams 36 and 36*a*** are differently shaped in this arrangement.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for feeding cartridges from a drum magazine to a firing weapon, comprising:

a drum magazine containing a predetermined number of sectors;

each one of said predetermined number of sectors containing a row of cartridges;

first conveying means for consecutively outwardly displacing said rows of cartridges from said predetermined number of sectors of said drum magazine;

second conveying means for receiving said cartridges from said rows of cartridges outwardly displaced by said first conveying means and for delivering said cartridges to the firing weapon;

rotary drive means for rotatably driving said drum magazine in a predetermined rotational direction;

each one of said predetermined number of sectors of said drum magazine arriving at a removal location during rotation of said drum magazine in said predetermined rotational direction under the action of said rotary drive means;

said first conveying means outwardly displacing in a predetermined direction said row of cartridges which are associated with said drum magazine sector placed in said removal location;

said first conveying means being arranged at a predetermined inclination formed as a resultant of said predetermined rotational direction of said drum magazine and said predetermined direction in which said row of cartridges is outwardly displaced from said drum magazine sector placed in said removal location;

a return movement blocking device arranged between said first conveying means and said second conveying means for preventing said cartridges from dropping into already emptied sectors of said predetermined number of sectors;

said return movement blocking device containing at least two pivotable flaps;

said at least two pivotable flaps being operatively associated with one another and conjointly forming a substantially funnel-shaped, pivotable channel through which said cartridges are passed by means of said first conveying means from said drum magazine to said second conveying means;

means operatively interconnecting said at least two pivotable flaps; and a cam plate cooperating with said at least two pivotable flaps for pivoting said at least two flaps.

2. The apparatus as defined in claim 1, wherein:

said at least two pivotable flaps constitute three pivotable flaps;

each one of said cartridges defining a first side, an opposite second side, a first end portion and a second end portion opposite said first end portion;

a first one of said three pivotable flaps being located at a first side of said cartridges and engaging each cartridge at a predeterminate location thereof; and the other two of said three pivotable flaps being located at said opposite second side respectively and engaging each cartridge at said first and second end portions thereof.

3. An apparatus for feeding cartridges from a drum magazine to a firing weapon, comprising:

a drum magazine containing a predetermined number of sectors;

each one of said predetermined number of sectors containing a row of cartridges;

first conveying means for consecutively outwardly displacing said rows of cartridges from said predetermined number of sectors of said drum magazine;

second conveying means for receiving said cartridges from said rows of cartridges outwardly displaced by said first conveying means and for delivering said cartridges to the firing weapon;

rotary drive means for rotatably driving said drum magazine in a predetermined rotational direction;

each one of said predetermined number of sectors of said drum magazine arriving at a removal location during rotation of said drum magazine in said predetermined rotational direction under the action of said rotary drive means;

said first conveying means outwardly displacing in a predetermined direction said row of cartridges which are associated with said drum magazine sector placed in said removal location;

said first conveying means being arranged at a predetermined inclination formed as a resultant of said predetermined rotational direction of said drum magazine and said predetermined direction in which said row of cartridges is outwardly displaced from said drum magazine sector placed in said removal location;

a return movement blocking device arranged between said first conveying means and said second conveying means for preventing said cartridges from dropping into already emptied sectors of said predetermined number of sectors;

said return movement blocking device containing at least two pivotable flaps;

said at least two pivotable flaps being operatively associated with one another and conjointly forming a substantially funnel-shaped, pivotable channel through which said cartridges are passed by means of said first conveying means from said drum magazine to said second conveying means;

a slide member interconnecting said at least two pivotable flaps; and a cam plate cooperating with said at least two flaps for pivoting said at least two pivotable flaps.

4. An apparatus for feeding cartridges from a drum magazine to a firing weapon, comprising:

a drum magazine containing a predetermined number of sectors;

each one of said predetermined number of sectors containing a row of cartridges;

first conveying means for consecutively outwardly displacing said rows of cartridges from said predetermined number of sectors of said drum magazine;

second conveying means for receiving said cartridges from said rows of cartridges outwardly displaced by said first conveying means and for delivering said cartridges to the firing weapon;

rotary drive means for rotatably driving said drum magazine in a predetermined rotational direction;

each one of said predetermined number of sectors of said drum magazine arriving at a removal location during rotation of said drum magazine in said predetermined rotational direction under the action of said rotary drive means;

said first conveying means outwardly displacing in a predetermined direction said row of cartridges which are associated with said drum magazine sector placed in said removal location;

said first conveying means being arranged at a predetermined inclination formed as a resultant of said predetermined rotational direction of said drum magazine and said predetermined direction in which said row of cartridges is outwardly displaced from said drum magazine sector placed in said removal location;

a return movement blocking device arranged between said first conveying means and said second conveying means for preventing said cartridges from dropping into already emptied sectors of said predetermined number of sectors;

said return movement blocking device containing at least two pivotable flaps;

said at least two pivotable flaps being operatively associated with one another and conjointly forming a substantially funnel-shaped, pivotable channel through which said cartridges are passed by means of said first conveying means from said drum magazine to said second conveying means;

at least two cam plates;

each one of said at least two cam plates being operatively associated with an associated one of said at least two pivotable flaps; and each one of said cam plates cooperating with the associated one of said at least two pivotable flaps for individually pivoting said associated pivotable flap.

* * * * *

UNITED STATES PATENT AND TRADEMARK OFFICE

CERTIFICATE OF CORRECTION

PATENT NO. : 4,742,756

DATED : May 10, 1988

INVENTOR(S) : PETER MANNHART

It is certified that error appears in the above-identified patent and that said Letters Patent is hereby corrected as shown below:

Column 2, line 38, after "manifested" please insert --by--

Column 5, line 23, please delete "container"

Signed and Sealed this

Twenty-ninth Day of November, 1988

*Attest:*

DONALD J. QUIGG

*Attesting Officer*

*Commissioner of Patents and Trademarks*